US010917712B2

(12) United States Patent
Wang

(10) Patent No.: US 10,917,712 B2
(45) Date of Patent: Feb. 9, 2021

(54) SPEAKER AND EARPLUG EARPHONES

(71) Applicant: GOERTEK TECHNOLOGY CO., LTD., Shandong (CN)

(72) Inventor: Chengqian Wang, Shandong (CN)

(73) Assignee: GOERTEK TECHNOLOGY CO., LTD., Shandong (CN)

( * ) Notice: Subject to any disclaimer, the term of this patent is extended or adjusted under 35 U.S.C. 154(b) by 0 days.

(21) Appl. No.: 16/471,585

(22) PCT Filed: Jul. 17, 2017

(86) PCT No.: PCT/CN2017/093098
§ 371 (c)(1),
(2) Date: Jun. 20, 2019

(87) PCT Pub. No.: WO2018/157535
PCT Pub. Date: Sep. 7, 2018

(65) Prior Publication Data

US 2020/0100015 A1 Mar. 26, 2020

(30) Foreign Application Priority Data

Mar. 1, 2017 (CN) ..... 2017 1 0117347

(51) Int. Cl.
*H04R 1/00* (2006.01)
*H04R 1/10* (2006.01)
(Continued)

(52) U.S. Cl.
CPC ..... *H04R 1/1075* (2013.01); *H04R 1/1016* (2013.01); *H04R 1/1091* (2013.01);
(Continued)

(58) Field of Classification Search
CPC ..... H04R 1/00; H04R 2205/022; H04R 2201/401; H04R 2201/405; H04R 1/30; H04R 1/2861; H04R 1/2865
(Continued)

(56) References Cited

U.S. PATENT DOCUMENTS 4,472,605 A * 9/1984 Klein ..... H04R 1/403 381/186
7,499,555 B1 * 3/2009 Isvan ..... H04R 1/1075 381/182
(Continued)

FOREIGN PATENT DOCUMENTS

CN 104159179 A 11/2014
CN 204350254 U 5/2015
(Continued)

OTHER PUBLICATIONS

International Search Report for PCT/CN2017/093098 dated Nov. 28, 2017, ISA/CN.

*Primary Examiner* — Suhan Ni
(74) *Attorney, Agent, or Firm* — Yue (Robert) Xu; Apex Attorneys at Law, LLP

(57) ABSTRACT

A speaker and earplug earphones are provided. The speaker includes a cylindrical speaker housing. A partition board arranged along a radial direction is disposed in an enclosed cavity. A first speaker and a second speaker are respectively disposed on both sides of the partition board, and each includes a magnetic circuit system and a vibrating system. A magnetic gap is disposed between the magnetic circuit system and the speaker housing, and an air pressure balance holes are formed in the partition board located at the magnetic gap. The vibrating system includes a voice coil and a vibrating diaphragm covering the end part of the speaker housing. Each earplug earphone includes an earphone front housing and an earphone back housing. The speaker is
(Continued)

mounted in the enclosed space. Multiple front housing sound output holes is formed in the earphone front housing. An acoustic waterproof membrane is disposed between the multiple front housing sound output holes and the speaker.

14 Claims, 2 Drawing Sheets

(51) Int. Cl.

| | |
|---|---|
| ***H04R 1/28*** | (2006.01) |
| ***H04R 9/02*** | (2006.01) |
| ***H04R 9/04*** | (2006.01) |
| ***H04R 9/06*** | (2006.01) |

(52) U.S. Cl.
CPC ..... *H04R 1/2826* (2013.01); *H04R 9/025* (2013.01); *H04R 9/045* (2013.01); *H04R 9/06* (2013.01); *H04R 2400/11* (2013.01); *H04R 2460/11* (2013.01)

(58) Field of Classification Search
USPC ..... 381/182, 186, 342, 370
See application file for complete search history.

(56) References Cited

U.S. PATENT DOCUMENTS

| | | | | |
|---|---|---|---|---|
| 10,117,018 | B2 | 10/2018 | Shao et al. | |
| 10,469,951 | B2 * | 11/2019 | Morgan ..... | H04R 9/063 |
| 2007/0098209 | A1 * | 5/2007 | Setiabudi ..... | H04R 9/063 381/420 |

FOREIGN PATENT DOCUMENTS

| | | | |
|---|---|---|---|
| CN | 105100996 | A | 11/2015 |
| CN | 205754772 | U | 11/2016 |
| CN | 106851457 | A | 6/2017 |
| JP | 2015019342 | A | 1/2015 |

* cited by examiner

SPEAKER AND EARPLUG EARPHONES

CROSS-REFERENCE TO RELATED APPLICATIONS

This application is a National Phase entry of PCT Application No. PCT/CN2017/093098, filed on Jul. 17, 2017, which claims priority to Chinese Patent Application No. 201710117347.8, titled "SPEAKER AND EARBUDS", filed with the China National Intellectual Property Administration on Mar. 01, 2017, the entire disclosure of which are incorporated herein by reference.

FIELD

The present application relates to the technical field of earphones, and in particular to a speaker and earbuds.

BACKGROUND

With the rapid development of technology, there is an increasingly demand for quality of life, and consumer electronics are developed towards high quality, and such trend is pretty obvious in the research, development and manufacture of earphones. Like mobile phones with various bands, earphones are developed to have waterproof functions, and these earphones are expected to not only be waterproof, but also have better sound effects while being waterproof.

At present, a waterproof earphone uses the following technology: a present tuning technology, that is, providing sound release holes for the back sound cavity of the speaker to extend the low frequency, and the sound release holes need to be clear and have a high air permeability, however, due to the low air permeability of the IPX7 waterproof material which is basically airtight and cannot meet the two conditions required for the sound holes: first condition is clear and second condition is a high air permeability, the low frequency effect is poor. If the low frequency effect is improved only by increasing the volume of the rear sound cavity, the volume of the product will increase, which makes the product look cumbersome and destroy the aesthetics of the product. When the enclosed rear sound cavity is in the working process of the speaker, that is, when the vibration diaphragm vibrates, the vibration diaphragm will compress the volume of the rear sound cavity, which causes the internal pressure of the rear sound cavity is increased, and the reaction force in turn applies to the vibration diaphragm, thereby weakening the vibration force of the vibration diaphragm and causing the speaker failing to release a strong enough low frequency effect.

SUMMARY

A first object of the present application is to provide a speaker device capable of enhancing the vibration performance and increasing the low frequency effect.

The present application is implemented in the form of a speaker device, the speaker device includes a speaker bracket, the speaker bracket includes a cylindrical speaker housing, and a partition plate is arranged in a radial direction in a cavity enclosed by the speaker housing; a first speaker and a second speaker are respectively arranged on two sides of the partitioning plate, and each of the first speaker and the second speaker includes a magnetic circuit system fixed on the partition plate, and a vibration system, an edge portion of which is fixed at an end portion of the speaker housing on a corresponding side; the magnetic circuit system includes a magnet and a washer which are sequentially fixed on the partition plate, a magnetic gap is provided between the magnet together with the washer and the speaker housing, and an air pressure balance hole is provided on the partition plate at the magnetic gap position; and the vibration system includes a voice coil and a vibration diaphragm covering the end portion of the speaker housing, and the voice coil is fixedly connected to a side surface of the vibration diaphragm.

As an improvement, a flange is provided on each outer side of both end portions of the speaker housing, and the edge portion of the vibration system is fixed on the flange.

As an improvement, through holes are respectively provided on opposite sides of the flange, a first speaker positive electrode and a first speaker negative electrode are respectively arranged at two through holes corresponding to a side of the flange adjacent to the first speaker, which are electrically connected to two ends of the voice coil of the first speaker, respectively; and a second speaker positive electrode and a second speaker negative electrode are respectively arranged at two through holes corresponding to a side of the flange adjacent to the second speaker, which are electrically connected to two ends of the voice coil of the second speaker, respectively.

As an improvement, multiple air pressure balance holes are provided.

As an improvement, the multiple air pressure balance holes are arranged in a ring-shaped array.

Since the above technical solution is adopted, the speaker device according to the present application includes a cylindrical speaker housing, and a partition plate is arranged in a radial direction in a cavity enclosed by the speaker housing; a first speaker and a second speaker are respectively arranged on two sides of the partitioning plate, and each of the first speaker and the second speaker includes a magnetic circuit system fixed on the partition plate, and a vibration system of which an edge portion is fixed at an end portion of the speaker housing on the corresponding side; the magnetic circuit system includes a magnet and a washer which are sequentially fixed on the partition plate, a magnetic gap is provided between the magnet together with the washer and the speaker housing, and an air pressure balance hole is provided on the partition plate at the magnetic gap position; and the vibration system includes a voice coil and a vibration diaphragm covering the end portion of the speaker housing, and the voice coil is fixedly connected to a side surface of the vibration diaphragm. During operation, the voice coil of the first speaker and the voice coil of the second speaker are respectively supplied with signal currents in different polarities, and the electromagnetic induction generates vibration forces in a same direction, so that a vibration direction of the vibration diaphragm of the first speaker and a vibration direction of the vibration diaphragm of the second speaker are the same, thereby the vibration performance is enhanced, the low frequency effect is improved, and the acoustic performance is improved.

A second object of the present application is to provide a waterproof earbud, which aims to solve the problem of poor low frequency effect of the existing earbud, and can improve the acoustic performance.

The present application is implemented in the form of an earbud, the earbud includes a front earbud housing and a rear earbud housing which are fastened together, and the speaker device as described above is mounted in a space enclosed by the front earbud housing and the rear earbud housing, multiple front housing sound output holes is arranged on the front earbud housing, and an acoustic waterproof membrane is provided between the multiple front housing sound output holes and the speaker device.

As an improvement, the first speaker or the second speaker of the speaker device is arranged towards the front earbud housing.

As an improvement, an earbud wire hole is arranged at an end of the rear earbud housing away from the front earbud housing, and a flexible wire clip is mounted in the earbud wire hole.

Since the above technical solution is adopted, the earbud provided by the present application includes a front earbud housing and a rear earbud housing which are fastened together, the speaker device is installed in a space enclosed by the front earbud housing and the rear earbud housing, a plurality of front housing sound output holes is arranged on the front earbud housing, and an acoustic waterproof membrane is arranged between the multiple front housing sound output holes and the speaker device. Since the speaker device as described above is mounted in the space enclosed by the front earbud housing and the rear earbud housing, the vibration direction of the vibration diaphragm of the first speaker and the vibration direction of the vibration diaphragm of the second speaker of the speaker device are the same, which enhances the vibration performance and improves the low frequency effect and the acoustic performance of the earbud, and since an acoustic waterproofing membrane is arranged between the multiple front housing sound output holes and the speaker device while no sound output hole is arranged on the rear earbud housing, the waterproof performance of the earbud is enhanced.

Figure 1:
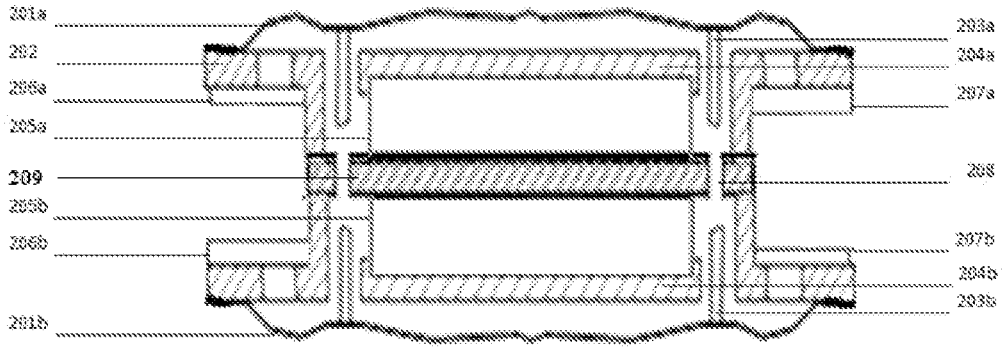
FIG. 1 is a schematic sectional view showing the structure of a speaker according to an embodiment of the present application.

Reference numerals in the drawings:

101*a* front earbud housing, 101*b* rear earbud housing, 102 acoustic waterproof membrane, 103 earplug portion, 104 front housing sound output hole case, 105 a first speaker, 105*b* second speaker, 106 rear sound cavity, 107 third cavity, 108 second cavity, 109 first cavity, 110 earbud wire hole, 111 wire clip, 201*a* vibration diaphragm, 201*b* vibration diaphragm, 202 speaker bracket, 203*a* voice coil, 203*b* voice coil, 204*a* washer, 204*b* washer, 205*a* magnet, 205*b* magnet, 206*a* first speaker positive electrode, 206*b* second speaker positive electrode, 207*a* first speaker negative electrode, 207*b* second speaker negative electrode, 208 air pressure balance hole, 209 partition plate.

DETAILED DESCRIPTION OF THE EMBODIMENTS

To make the objects, solutions and advantages of the present application more clear and apparent, the present application is described in detail in conjunction with the drawings and embodiments. It should be understood that the specific embodiments described herein are merely for explaining the present application, and are not intended to limit the present application.

Figure 2:
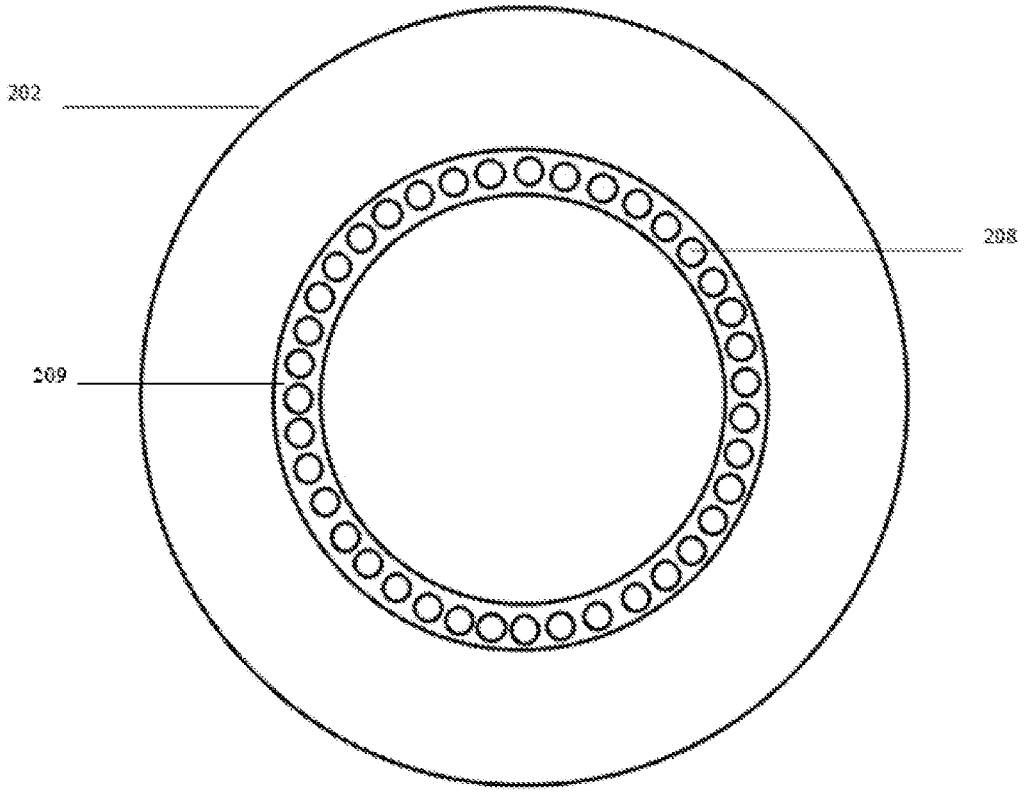
FIG. 2 is a schematic top view showing the structure of a speaker bracket according to the embodiment of the present application.

As can be seen from FIG. 1 and FIG. 2, a speaker device includes a speaker bracket 202, the speaker bracket 202 includes a cylindrical speaker housing, a partition plate 209 is arranged in a radial direction in a cavity enclosed by the speaker housing, and the partition plate 209 divides the cavity enclosed by the speaker housing into two parts. A first speaker 105*a* and a second speaker 105*b* are respectively arranged on two sides of the partitioning plate, and each of the first speaker 105*a* and the second speaker 105*b* includes a magnetic circuit system fixed on the partition plate 209, and a vibration system, an edge portion of which is fixed at an end portion of the speaker housing on a corresponding side. The magnetic circuit system includes a magnet fixed on the partition plate 209 and a washer fixedly connected with the magnet, a magnetic gap is provided between the magnet together with the washer and the speaker housing, and an air pressure balance hole 208 is provided on the partition plate 209 at the magnetic gap position. In the present embodiment, multiple air pressure balance holes 208 are provided in a ring-shaped array; and the vibration system includes a voice coil encircling the magnet and the washer and a vibration diaphragm covering the end portion of the speaker housing, and the voice coil is fixedly connected to a side surface of the vibration diaphragm. A second cavity 108 is formed by enclosure of the vibration diaphragm 201*a* of the first speaker 105*a* and the speaker housing, a third cavity 107 is formed by enclosure of the vibration diaphragm 201*b* of the second speaker 105*b* and the speaker housing, and the second cavity 108 communicates with the third cavity 107 through the air pressure balance holes 208.

Specifically, a magnetic circuit system of the first speaker 105*a* includes a magnet 205*a* fixedly connected to the partition plate 209 and a washer 204*a* fixedly connected to the magnet 205*a*, the vibration system of the first speaker 105*a* includes a voice coil 203*a* encircling the magnet 205*a* and the washer 204*a* and a vibration diaphragm 201*a* covering at one end portion of the speaker housing, and the voice coil 203*a* is fixedly connected to one side surface of the vibration diaphragm 201*a;* and a magnetic circuit system of the second speaker 105*b* includes a magnet 205*b* fixedly connected to the partition plate 209 and a washer 204*b* fixedly connected to the magnet 205*b,* the vibration system of the second speaker 105*b* includes a voice coil 203*b* encircling the magnet 205*b* and the washer 204*b* and a vibration diaphragm 201*b* covering at the other end portion of the speaker housing, and the voice coil 203*b* is fixedly connected to the other side surface of the vibration diaphragm 201*b.*

A flange is provided on each outer side of both end portions of the speaker housing, an edge portion of the vibration system is fixed on the flange, that is, an edge portion of the vibration diaphragm is fixed on the flange, and through holes are respectively provided on opposite sides of the flanges; a first speaker positive electrode 206*a* and a first speaker negative electrode 207*a* are respectively arranged at two through holes corresponding to a side of the flange adjacent to the first speaker 105*a,* and the first speaker positive electrode 206*a* and the first speaker negative electrode 207*a* are electrically connected to two ends of the voice coil 203*a*, respectively; and, a second speaker positive electrode 206*b* and a second speaker negative electrode 207*b* are respectively arranged at two through holes corresponding to a side of the flange adjacent to the second speaker 105*b,* which are electrically connected to two ends of the voice coil 203*b,* respectively.

During operation, the voice coil 203*a* of the first speaker 105*a* and the voice coil 203*b* of the second speaker 203*b* are respectively supplied with signal currents in different polarities, and the electromagnetic induction generates vibration forces in a same direction, so that a vibration direction of the vibration diaphragm 201*a* of the first speaker 105*a* and a vibration direction of the vibration diaphragm 201*b* of the second speaker 105*b* are the same, thereby the vibration performance is enhanced, the low frequency effect is improved, and the acoustic performance is improved.

Figure 3:
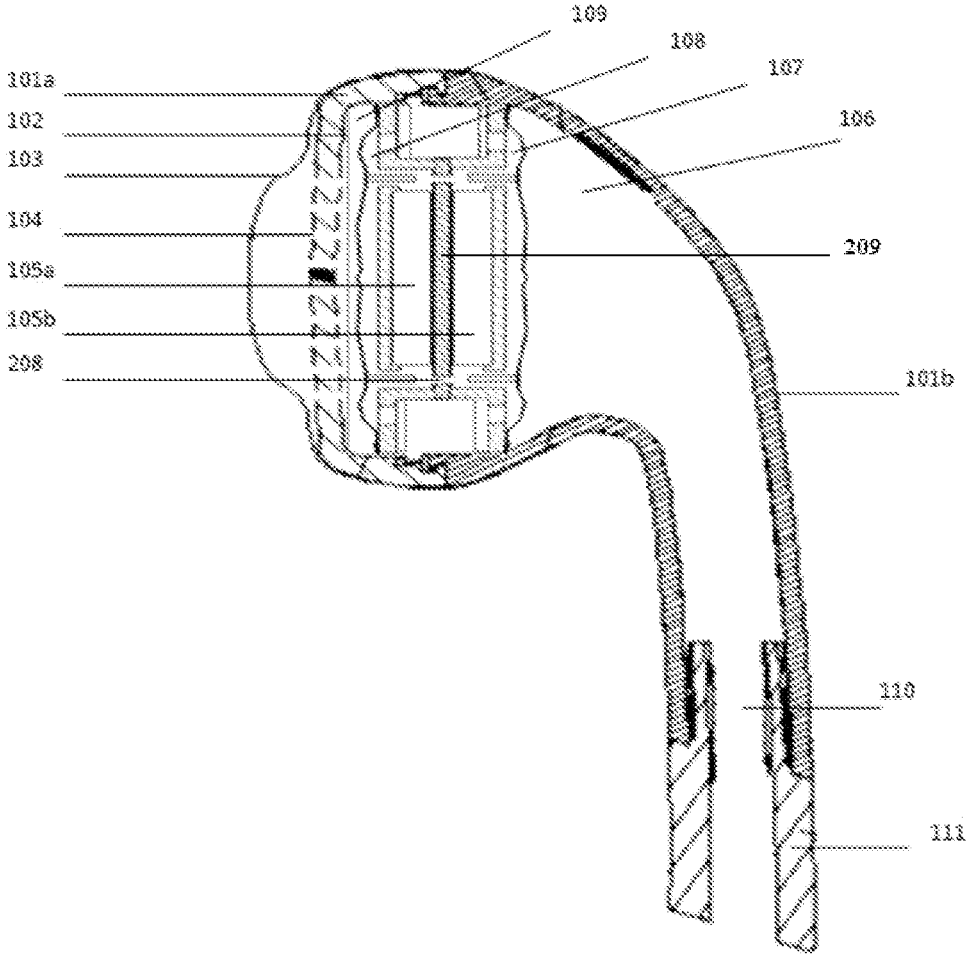
FIG. 3 is a schematic sectional view showing the structure of an earbud according to the embodiment of the present application.

As can be seen from FIG. 3, an earbud includes a front earbud housing 101*a* and a rear earbud housing 101*b* which are fastened together. The speaker device as described above is arranged in a space enclosed by the front earbud housing 101*a* and the rear earbud housing 101*b*, the speaker device divides the space enclosed by the front earbud housing 101*a* and the rear earbud housing 101*b* into a front sound cavity and a rear sound cavity 106. A plurality of front housing sound output holes 104 is arranged on the front earbud housing 101*a*, an acoustic waterproof membrane 102 is arranged between the plurality of front housing sound output holes 104 and the speaker device, and a first cavity 109 is formed by enclosure of the acoustic waterproof membrane 102 and the vibration diaphragm 201*a* of the first speaker 105*a*. The first speaker 105*a* or the second speaker 105*b* of the speaker device is arranged towards the front earbud housing 101*a* to facilitate the transmission of sound, and an earplug portion 103 is mounted on an outer side of the front earbud housing 101*a* to facilitate inserting the earbud into an ear.

Since the speaker device as described above is mounted in the space enclosed by the front earbud housing 101*a* and the rear earbud housing 101*b*, the vibration direction of the vibration diaphragm 201*a* of the first speaker 105*a* and the vibration direction of the vibration diaphragm 201*b* of the second speaker 105*b* of the speaker device are the same, which enhances the vibration performance and improves the low frequency effect and the acoustic performance of the earbud; and since the acoustic waterproofing membrane 102 is arranged between the plurality of front housing sound output holes 104 and the speaker device while no sound output hole is arranged on the rear earbud housing 101*b*, the waterproof performance of the earbud is enhanced.

In the present embodiment, the acoustic waterproof membrane 102 has a waterproof rating of IPX7. Obviously, it is also applicable to choose a higher waterproof rating or a lower waterproof rating according to a specific working environment.

In the present embodiment, an earbud wire hole 110 is arranged at an end of the rear earbud housing 101*b* away from the front earbud housing 101*a*, and a flexible wire clip 111 is mounted in the earbud wire hole 110 to prevent the earbud wire from being broken and prolong a service life thereof.

The above are only the better embodiments of the present application and are not intended to limit the present application. Any changes, equivalent substitutions, improvements and the like made within the spirit and principles of the present application are all contained in the protection scope of the present application.

The invention claimed is:

1. A speaker device, comprising:

a speaker bracket, wherein the speaker bracket comprises a speaker housing in a cylindrical shape, and a partition plate is arranged in a radial direction in a cavity enclosed by the speaker housing, wherein a first speaker and a second speaker are respectively arranged on two sides of the partitioning plate, and each of the first speaker and the second speaker comprises a magnetic circuit system fixed on the partition plate and a vibration system, an edge portion of which is fixed at an end portion of the speaker housing on a corresponding side;

wherein the magnetic circuit system comprises a magnet and a washer which are sequentially fixed on the partition plate, a magnetic gap is provided between the magnet together with the washer and the speaker housing, and an air pressure balance hole is provided on the partition plate at the magnetic gap position; and the vibration system comprises a voice coil and a vibration diaphragm covering the end portion of the speaker housing, and the voice coil is fixedly connected to a side surface of the vibration diaphragm.

2. The speaker device according to claim 1, wherein a flange is provided on each outer side of both end portions of the speaker housing, and the edge portion of the vibration system is fixed on the flange.

3. The speaker device according to claim 2, wherein through holes are respectively provided on opposite sides of the flange, a first speaker positive electrode and a first speaker negative electrode are respectively arranged at two through holes corresponding to a side of the flange adjacent to the first speaker, and, the first speaker positive electrode and the first speaker negative electrode are electrically connected to two ends of the voice coil of the first speaker, respectively; and, a second speaker positive electrode and a second speaker negative electrode are respectively arranged at two through holes corresponding to a side of the flange adjacent to the second speaker, and, the second speaker positive electrode and the second speaker negative electrode are electrically connected to two ends of the voice coil of the second speaker, respectively.

4. The speaker device according to claim 3, wherein a plurality of air pressure balance holes is provided.

5. An earbud, comprising:

a front earbud housing, and a rear earbud housing wherein the front earbud housing and the rear earbud housing are fastened together, and the speaker device according to claim 3 is mounted in a space enclosed by the front earbud housing and the rear earbud housing, a plurality of front housing sound output holes is arranged on the front earbud housing, and an acoustic waterproof membrane is provided between the plurality of front housing sound output holes and the speaker device.

6. The speaker device according to claim 2, wherein a plurality of air pressure balance holes is provided.

7. An earbud, comprising:

a front earbud housing, and a rear earbud housing wherein the front earbud housing and the rear earbud housing are fastened together, and the speaker device according to claim 2 is mounted in a space enclosed by the front earbud housing and the rear earbud housing, a plurality of front housing sound output holes is arranged on the front earbud housing, and an acoustic waterproof membrane is provided between the plurality of front housing sound output holes and the speaker device.

8. The speaker device according to claim 1, wherein a plurality of air pressure balance holes is provided.

9. The speaker device according to claim 8, wherein the plurality of the air pressure balance holes is arranged in a ring-shaped array.

10. An earbud, comprising:

a front earbud housing, and a rear earbud housing wherein the front earbud housing and the rear earbud housing are fastened together, and the speaker device according to claim 9 is mounted in a space enclosed by the front earbud housing and the rear earbud housing, a plurality of front housing sound output holes is arranged on the front earbud housing, and an acoustic waterproof membrane is provided between the plurality of front housing sound output holes and the speaker device.

11. An earbud, comprising:

a front earbud housing, and a rear earbud housing wherein the front earbud housing and the rear earbud housing are fastened together, and the speaker device according to claim 8 is mounted in a space enclosed by the front earbud housing and the rear earbud housing, a plurality of front housing sound output holes is arranged on the front earbud housing, and an acoustic waterproof membrane is provided between the plurality of front housing sound output holes and the speaker device.

12. An earbud, comprising:

a front earbud housing, and a rear earbud housing wherein the front earbud housing and the rear earbud housing are fastened together, and the speaker device according to claim 1 is mounted in a space enclosed by the front earbud housing and the rear earbud housing, a plurality of front housing sound output holes is arranged on the front earbud housing, and an acoustic waterproof membrane is provided between the plurality of front housing sound output holes and the speaker device.

13. The earbud according to claim 12, wherein the first speaker or the second speaker of the speaker device is arranged towards the front earbud housing.

14. The earbud according to claim 12, wherein an earbud wire hole is arranged at an end of the rear earbud housing away from the front earbud housing, and a flexible wire clip is mounted in the earbud wire hole.

* * * * *